US009017041B2

(12) United States Patent
Cuneo et al.

(10) Patent No.: US 9,017,041 B2
(45) Date of Patent: Apr. 28, 2015

(54) VARIABLE DISPLACEMENT LUBRICANT PUMP

(75) Inventors: Carmine Cuneo, Pisa (IT); Giacomo Armenio, Leghorn (IT)

(73) Assignee: Pierburg Pump Technology GmbH, Neuss (DE)

( * ) Notice: Subject to any disclaimer, the term of this patent is extended or adjusted under 35 U.S.C. 154(b) by 335 days.

(21) Appl. No.: 13/582,460

(22) PCT Filed: Mar. 5, 2010

(86) PCT No.: PCT/EP2010/052825

§ 371 (c)(1),
(2), (4) Date: Oct. 31, 2012

(87) PCT Pub. No.: WO2011/107156

PCT Pub. Date: Sep. 9, 2011

(65) Prior Publication Data

US 2013/0039790 A1 Feb. 14, 2013

(51) Int. Cl.

| | |
|---|---|
| ***F04C 2/344*** | (2006.01) |
| ***F04C 14/22*** | (2006.01) |
| ***F04C 14/24*** | (2006.01) |

(52) U.S. Cl.

CPC ..... *F04C 2/3442* (2013.01); *F04C 2/344* (2013.01); *F04C 2270/185* (2013.01); *F04C 14/22* (2013.01); *F04C 14/24* (2013.01); *F04C 2240/20* (2013.01); *F04C 2270/052* (2013.01); *F04C 2270/18* (2013.01); *F04C 2270/58* (2013.01)

(58) Field of Classification Search

CPC .... F04C 2/344; F04C 2/3442; F04C 2270/18; F04C 2270/185; F02B 17/05

USPC ..... 417/219, 220; 418/17, 22, 24, 27, 28, 418/30, 31, 268; 137/53, 56, 57

See application file for complete search history.

(56) References Cited

U.S. PATENT DOCUMENTS

| | | | | |
|---|---|---|---|---|
| 2,762,195 | A * | 9/1956 | Nubling | 60/444 |
| 4,265,265 | A * | 5/1981 | Wallace et al. | 137/56 |
| 5,690,479 | A | 11/1997 | Lehmann et al. | |
| 2002/0085923 | A1 | 7/2002 | Konishi | |

(Continued)

FOREIGN PATENT DOCUMENTS

| | | | |
|---|---|---|---|
| CN | 201407301 | Y | 2/2010 |
| DE | 198 57 726 | A1 | 8/2000 |
| DE | 10 2004 049 029 | A1 | 4/2006 |
| EP | 1 350 930 | A1 | 10/2003 |

(Continued)

*Primary Examiner* — Devon Kramer
*Assistant Examiner* — Patrick Hamo
(74) *Attorney, Agent, or Firm* — Norman B. Thot

(57) ABSTRACT

A variable displacement lubricant pump includes a first plunger which pushes a shiftable control ring into a high pumping volume direction. A pump rotor comprises radially slidable vanes which rotate in the control ring. A pressure control system comprises a first pressure control chamber wherein a first plunger is axially moveable. A first pressure conduit connects a pump outlet port with the first pressure control chamber. A first pressure control valve controls a pressure in the first pressure control chamber. A second pressure control valve between an outlet opening in a side wall of the first pressure control chamber and a low pressure source controls the outlet opening and is a centrifugal valve mechanically connected with the pump rotor which closes at a high rotational speed of the pump rotor. The outlet opening is closed by the first plunger in a low pumping volume position and opened in a high pumping volume position.

8 Claims, 2 Drawing Sheets

(56) References Cited

U.S. PATENT DOCUMENTS

| | | | | |
|---|---|---|---|---|
| 2003/0231965 | A1 | 12/2003 | Hunter et al. | |
| 2008/0038117 | A1 | 2/2008 | Armenio et al. | |
| 2008/0069704 | A1 * | 3/2008 | Armenio et al. | 417/310 |

FOREIGN PATENT DOCUMENTS

| | | | |
|---|---|---|---|
| GB | 1 435 451 | A | 5/1976 |
| WO | WO 94/29595 | A1 | 12/1994 |
| WO | WO 2005/026553 | A1 | 3/2005 |

* cited by examiner

VARIABLE DISPLACEMENT LUBRICANT PUMP

CROSS REFERENCE TO PRIOR APPLICATIONS

This application is a U.S. National Phase application under 35 U.S.C. §371 of International Application No. PCT/EP2010/052825, filed on Mar. 5, 2010. The International Application was published in English on Sep. 9, 2011 as WO 2011/107156 A1 under PCT Article 21(2).

FIELD

The present invention refers to a variable displacement lubricant pump for providing pressurized lubricant for an internal combustion engine.

BACKGROUND

The mechanical pump comprises a pump rotor with radially slidable vanes rotating in a shiftable control ring, whereby the control ring is pushed by a first plunger pushing the control ring into high pumping volume direction. The pump further comprises a pressure control system for controlling the discharge pressure of the pressurized lubricant, whereby the control system comprises a first pressure control chamber wherein the first plunger is provided axially moveable. The pump is provided with a first pressure conduit which connects a pump outlet port with the first control chamber. The pump is also provided with a first pressure control valve which controls the pressure in the first pressure control chamber.

Variable displacement vane pumps of the state of the art are described in WO 2005/026553 A1. The pump is provided with a pressure control system for controlling the discharge pressure of the lubricant. The pressure control system comprises a first pressure control chamber wherein a first plunger is provided being axially movable. The first pressure control chamber is connected via a first pressure conduit with the pump outlet port. The pressure control system also comprises a separate control element which is realized as a cylinder-piston-element which keeps the pressure of the pressurized lubricant provided by the pump at a more or less constant level, independent of the rotational speed of the pump rotor. This is realized by opening and closing a control outlet of the first pressure control chamber, thereby moving the control ring into a low pumping volume direction or pushing into a high pumping volume direction.

The lubricant pressure requirement is, however, dependent on the working conditions of the engine. The lubricant pressure requirement is lower at low rotational speeds and higher at high rotational speeds of the engine.

A device with a control system which provides two levels of pressure of the pressurized lubricant is described in DE 10 2004 049 029 A1. The pressure control of the device is performed by using an electromagnetic valve. Electromagnetic valves are not, however, fail-safe, so that an electrical power loss can lead to an insufficient lubrication of the engine.

SUMMARY

An aspect of the present invention is to provide a variable displacement lubricant pump with a control system which provides two levels of pressure of the pressurized lubricant with improved reliability.

In an embodiment, the present invention provides a variable displacement lubricant pump for providing a pressurized lubricant for an internal combustion engine which includes a control ring which is configured to be shiftable. A first plunger is configured to push the control ring into a high pumping volume direction. A pump rotor comprises radially slidable vanes which are configured to rotate in the control ring. A pressure control system is configured to control a discharge pressure of a pressurized lubricant. The pressure control system comprises a first pressure control chamber wherein a first plunger is arranged to be axially moveable. A first pressure conduit is configured to connect a pump outlet port with the first pressure control chamber. A first pressure control valve is configured to control a pressure in the first pressure control chamber. An outlet opening is disposed in a side wall of the first pressure control chamber. A second pressure control valve is disposed between the outlet opening and a low pressure source. The second pressure control valve is configured to control the outlet opening. The second pressure control valve is a centrifugal valve which is mechanically connected with the pump rotor and is configured to close at a high rotational speed of the pump rotor. The outlet opening is configured to be closed by the first plunger in a low pumping volume position and to be opened in a high pumping volume position.

BRIEF DESCRIPTION OF THE DRAWINGS

The present invention is described in greater detail below on the basis of embodiments and of the drawings in which.

DETAILED DESCRIPTION

Figure 1:
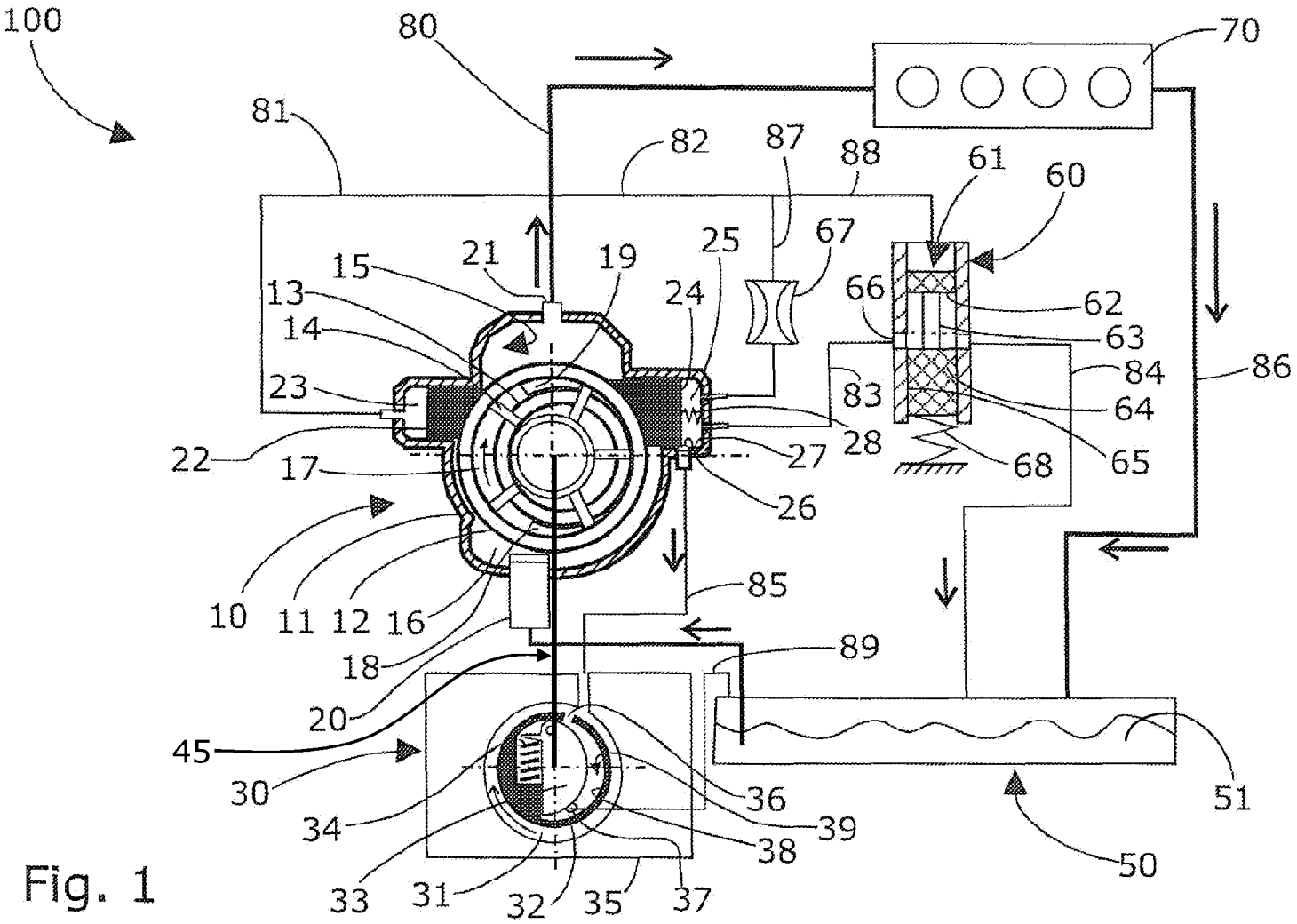
FIG. 1 shows a pumping system including a variable displacement vane pump.

The mechanical variable displacement lubricant pump has an outlet opening in a side wall of the first pressure control chamber, whereby the lubricant flows through the outlet opening. The outlet opening is controllable by a second pressure control valve positioned between the outlet opening and a low pressure source, which is, for example, the atmospheric pressure in a lubricant tank. The second pressure control valve is a centrifugal valve which is mechanically connected with the pump rotor and closes at a high rotational speed of the pump rotor. The outlet opening is additionally closed by the first plunger in a low pumping volume position and is left open in a high pumping volume position of the control ring. The combination of the first pressure control valve and the second pressure control valve provides a mechanical and fail-safe solution for a pressure control system which provides two levels of pressure of the delivered pressurized lubricant dependent on the rotational speed of the engine. At low rotational speed the delivery pressure is reduced.

In an embodiment of the present invention, the second pressure control valve comprises a rotatable main body being rotated by the pump rotor, whereby the main body is provided with a control opening and the control opening is closable by a valve body. The valve body is excentrically and pivotably mounted at the main body and is pushed into an open position by a pretensioning element. The control opening is open in the open position of the valve body. This is a simple and reliable engineering design for a rotational speed-dependent valve.

In an embodiment of the present invention, the second pressure control valve can, for example, be provided with a prechamber between a valve housing and the main body and with an outlet opening which is in a side wall of the second pressure main body or of the valve housing. The main body provides the control opening which is positioned radially at a cylindrical circumference wall. The prechamber is flooded with pressurized lubricant coming from the first pressure control chamber. As soon as the control opening of the rotating main body is in the open position, the lubricant flows through the control opening to the main body outlet opening to the low pressure source. When the rotational speed of the rotating main body reaches and exceeds a threshold speed, the resulting centrifugal force of the valve body is higher than the spring force of a pretensioning element, so that the control opening is closed by the valve body moving radially outwardly, so that the lubricant pressure is only controlled by the first pressure control valve.

In an embodiment of the present invention, the control port of the first pressure control valve can, for example, be connected with the outlet port of the pump. The first pressure control valve controls the lubricant pressure at high rotational speeds so that the lubricant pressure is more or less held constant at high rotational speed of the engine.

In an embodiment of the present invention, a pressure throttle valve can, for example, be positioned in the first pressure conduit. This throttle valve limits the maximum lubricant consumption of the pressure control system and is a relevant part of the pressure control system. The throttle valve defines the characteristic of the pressure control.

In an embodiment of the present invention, the pretensioning element can, for example, be a spring. A spring is provided with a spring tension so that a desired pretensioning of the spring is available. The spring tension determines the threshold speed of the centrifugal valve.

FIG. 1 shows a variable displacement lubricant pump 10 as a part of a pumping system 100 for supplying an internal combustion engine 70 with a lubricant 51. The pump comprises a pump housing 11 having a cavity 16 in which a radially shiftable control ring 12 translates.

The control ring 12 encircles a pump rotor 13 which is provided with numerous radially slidable vanes 14, whereby the vanes 14 are rotating inside the control ring 12. The pump housing 11 is closed by two pump side walls 15 of which one is not shown in the drawing. The pump side walls 15, the vanes 14, the pump rotor 13 and the control ring 12 define five rotating pump chambers 17. One of the side walls 15 is provided with a pump chamber inlet opening 18 and with a pump chamber outlet opening 19.

The control ring 12 is provided with a first plunger 24 housed in part in a first pressure control chamber 25 and with a second plunger 22 housed in part in a second control chamber 23 opposite to the first pressure control chamber 25.

A pretensioned spring 28 inside the first pressure control chamber 25 exerts a pushing force to the first plunger 24. Both control chambers 25, 23 are formed in the pump housing 11. The pump housing 11 also comprises an intake port 20 for sucking the lubricant 51 from a lubricant tank 50 and a pump outlet port 21 for feeding lubricant 51 with a discharge pressure to the engine 70. A conduit 80 extends from the pump outlet port 21 to supply the engine 70.

The lubricant 51, which is supplied to the engine 70, is conducted to the second control chamber 23 via a pressure conduit 81, and the lubricant 51 is fed to the first pressure control chamber 25 via pressure conduits 82, 87. More specifically, the lubricant 51 in pressure conduit 82 is finally fed to the first pressure control chamber 25 via a conduit 87 through a pressure throttle valve 67 in which a calibrated pressure drop occurs as the lubricant 51 flows through. The lubricant flows from the engine 70 via conduit 86 back to the lubricant tank 50.

The pressure conduits 82, 88 are connected to a first pressure control valve 60 by pressure conduit 88. The first pressure control valve 60 comprises a cylinder 65 housing a piston 61 which is pretensioned by a pretension element 68. More specifically, the piston 61 comprises a first piston portion 62 and a second piston portion 64 connected to each other by a rod 63. The first and second piston portions 62 and 64 are in cross section equal to cross section of the cylinder 65, whereas the rod 63 is smaller in cross section than the cylinder 65.

The cylinder 65 has an inlet port 66 connected hydraulically to the first pressure control chamber 25 by a conduit 83. The pressure conduit 88 provides the discharge pressure in pressure conduit 82 to the front surface of the first piston portion 62 of piston 61. The dash conduit in FIG. 1 shows the situation when the inlet port 66 of the first pressure control valve 60 is closed by the second piston portion 64 of the piston 61.

The first pressure control chamber 25 has an outlet opening 26 connected hydraulically to a second pressure control valve 30 by a conduit 85. The outlet opening 26 is provided in a side wall 27 of the first pressure control chamber 25 so that the first plunger 24 opens and closes the opening 26 dependent on the plunger position. The lubricant flows back to the lubricant tank 50 from the second pressure control valve 30 via a conduit 89.

The second pressure control valve 30 comprises a valve housing 35 with a main body 32. The main body 32 of the second pressure control valve 30 is mounted on the axis of the pump rotor 13 and is rotated by the pump rotor 13. The mechanical connection between the second pressure control valve 30 and the pump rotor 13 is shown as a solid line 45 in FIG. 1. The main body 32 is provided with a control opening 36 which is positioned radially at a circumference wall 38, and with a second outlet opening 37 in a side wall 39 of the second pressure control valve 30. The second pressure control valve 30 is provided with a prechamber 31 between the valve housing 35 and the main housing 32. The main body 32 houses a valve body 33 which is pivotably mounted and is held in an open position by a pretensioning element 34. The valve body 33 is a semi-circle mass body which is in equilibrium with the spring force of the pretensioning element 34 and the centrifugal force generated by the rotation of the main body 32 when the valve body 33 is pivoting between the open and the closed position. The pretensioning element 34 is a metal spring.

FIGS. 2*a* to 2*d* show the second pressure control valve 30 in an open position and in a closed position.

Figures 2A, 2B, 2C, 2D:
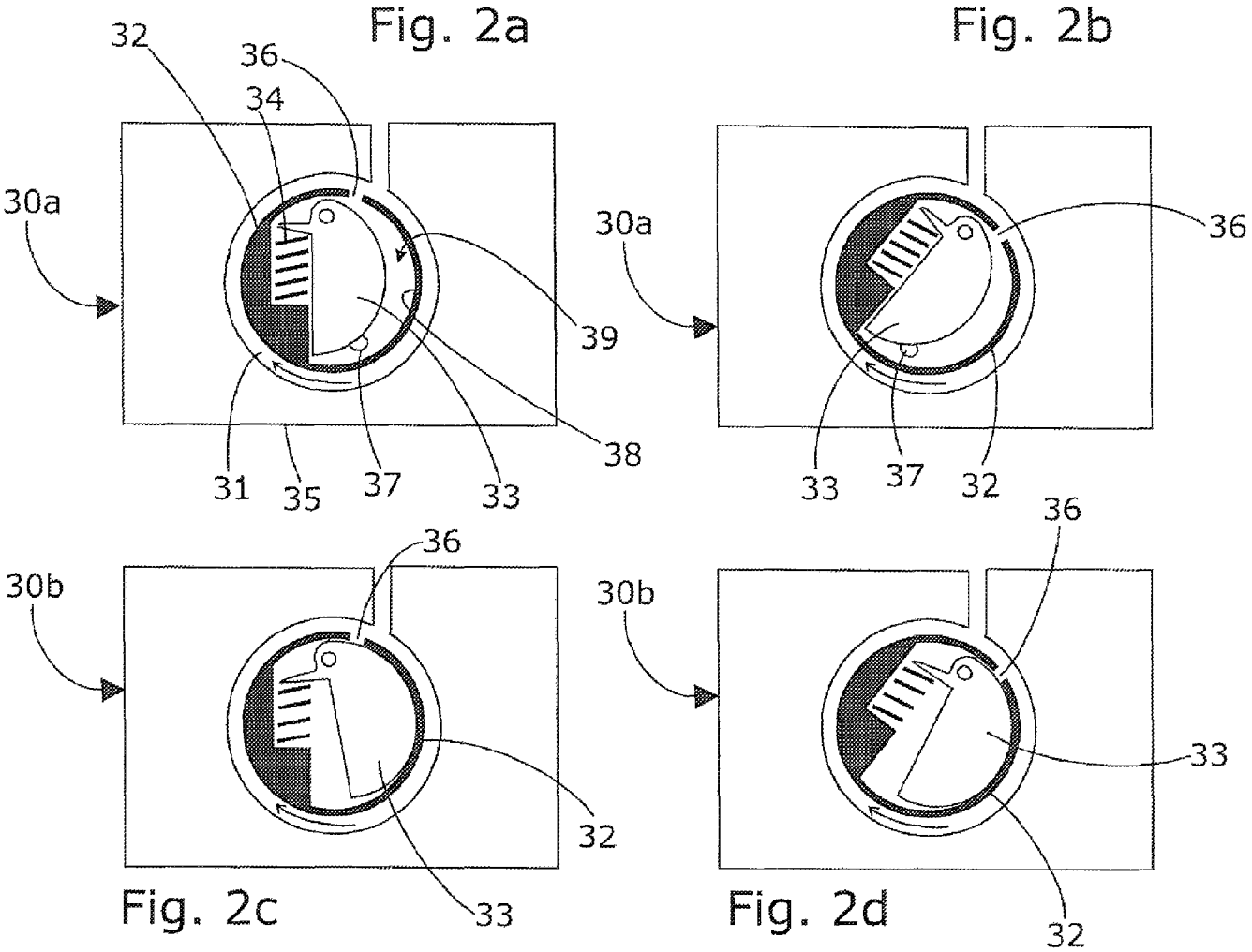
FIGS. 2*a* to 2*d* show the second pressure control valve of FIG. 1 in an open and a closed position.

When the rotational speed of the engine 70 is less than the threshold speed of, for example, 3,000 rpm, the second pressure control valve 30 is open. More specifically, the pretensioning element 34 keeps the valve body 33 in the open position as shown in FIGS. 2*a* and 2*b* showing the valve 30*a*. If the second pressure control valve 30*a* is open, the first plunger 24 is held at a constant position at the outlet opening 26 so that the pump 10 is driven with a more or less constant pumping volume, independent of the rotational speed of the pump.

When the rotational speed of the engine 70 is higher than the threshold speed, the second pressure control valve 30 is closed. More specifically, the resulting centrifugal force of the valve body 33 is higher than the spring force of a pretensioning element 34, so that the control opening 36 is closed by the valve body 33 as shown in FIGS. 2*c* and 2*d* showing the valve 30*b*.

If the second pressure control valve 30 is closed, the outlet opening 26 of the first pressure control chamber 25 is no longer connected to the low pressure source defined by the lubricant tank 50. The lubricant pressure in the first pressure control chamber 25 is then only controlled by the first pressure control valve 60, so that a high constant pump outlet pressure at the pump outlet port 21 is realized.

The present invention is not limited to embodiments described herein; reference should be had to the appended claims.

What is claimed is:

1. A variable displacement lubricant pump for providing a pressurized lubricant for an internal combustion engine, the variable displacement lubricant pump comprising:

a control ring which is configured to be shiftable;

a first plunger which is configured to push the control ring into a high pumping volume direction;

a pump rotor comprising radially slidable vanes which are configured to rotate in the control ring;

a pressure control system configured to control a discharge pressure of the pressurized lubricant, the pressure control system comprising a first pressure control chamber wherein the first plunger is arranged to be axially moveable;

a pump outlet port;

a first pressure conduit configured to connect the pump outlet port with the first pressure control chamber;

a first pressure control valve configured to control a pressure in the first pressure control chamber;

an outlet opening disposed in a side wall of the first pressure control chamber; and a second pressure control valve disposed between the outlet opening and a low pressure source, the second pressure control valve being configured to control the outlet opening, wherein, the second pressure control valve is a centrifugal valve which is mechanically connected with the pump rotor and is configured to close at a high rotational speed of the pump rotor, and the outlet opening is configured to be closed by the first plunger in a low pumping volume position and to be opened in a high pumping volume position.

2. The variable displacement lubricant pump as recited in claim 1, further comprising a valve body and a pretensioning element, wherein the second pressure control valve comprises a main body which is configured to be rotated by the pump rotor, and the main body comprises a control opening, and wherein the control opening is configured to be closed by the valve body which is mounted at the main body so as to pivot, the valve body is configured to be held in an open position by the pretensioning element, and the control opening is open when the valve body is in the open position.

3. The variable displacement lubricant pump as recited in claim 2, wherein the pretensioning element is a spring.

4. The variable displacement lubricant pump as recited in claim 2, wherein the main body further comprises a cylindrical circumference wall, and wherein the control opening is arranged radially at the cylindrical circumference wall.

5. The variable displacement lubricant pump as recited in claim 2, further comprising a valve housing, wherein the second pressure control valve comprises a prechamber which is arranged between the valve housing and the main body.

6. The variable displacement lubricant pump as recited in claim 5, wherein the valve housing comprises a valve housing side wall, and wherein the second pressure control valve comprises an outlet opening arranged in the valve housing side wall.

7. The variable displacement lubricant pump as recited in claim 1, wherein the first pressure control valve is connected with the pump outlet port.

8. The variable displacement lubricant pump as recited in claim 1, further comprising a pressure throttle valve arranged in the first pressure conduit.

* * * * *